US006736531B2

(12) United States Patent
Wallach

(10) Patent No.: US 6,736,531 B2
(45) Date of Patent: May 18, 2004

(54) READING LIGHT WITH SHUTOFF TIMER

(76) Inventor: Stewart Wallach, 6094 Via Crystalle, Delray Beach, FL (US) 33484

( * ) Notice: Subject to any disclaimer, the term of this patent is extended or adjusted under 35 U.S.C. 154(b) by 25 days.

(21) Appl. No.: 10/047,853

(22) Filed: Jan. 16, 2002

(65) Prior Publication Data

US 2003/0133304 A1 Jul. 17, 2003

(51) Int. Cl.[7] ..... F21S 8/08; F21V 23/00

(52) U.S. Cl. ..... 362/414; 362/395; 362/396; 362/427; 362/197; 362/98; 362/253

(58) Field of Search ..... 362/414, 413, 362/394, 395, 396, 427, 109, 98, 99, 197, 199, 253

(56) References Cited

U.S. PATENT DOCUMENTS

| | | | | | |
|---|---|---|---|---|---|
| 4,152,757 | A | * | 5/1979 | Bilson et al. | 362/217 |
| 4,283,661 | A | | 8/1981 | Doty | |
| 5,138,538 | A | | 8/1992 | Sperling | |
| 5,163,748 | A | * | 11/1992 | Messinger | 362/98 |
| 5,222,806 | A | * | 6/1993 | Roberts, III | 362/401 |
| 5,469,346 | A | | 11/1995 | Haut | |
| 5,632,552 | A | * | 5/1997 | Wang et al. | 362/396 |
| 5,957,564 | A | * | 9/1999 | Bruce et al. | 362/84 |
| 5,997,165 | A | | 12/1999 | Lehrer | |
| 6,023,819 | A | * | 2/2000 | Wong et al. | 24/510 |
| D427,703 | S | | 7/2000 | Chan | |
| D428,177 | S | | 7/2000 | Chan | |
| 6,236,622 | B1 | * | 5/2001 | Blackman | 368/10 |
| 6,249,089 | B1 | | 6/2001 | Bruwer | |
| 6,348,766 | B1 | * | 2/2002 | Ohishi et al. | 315/200 A |
| 6,361,184 | B1 | * | 3/2002 | Hallgrimsson et al. | 362/188 |
| 6,390,648 | B1 | * | 5/2002 | Privas et al. | 362/276 |

* cited by examiner

*Primary Examiner*—Alan Cariaso
*Assistant Examiner*—Mark Tsidulko
(74) *Attorney, Agent, or Firm*—Kevin P. Crosby, Esq.; Daniel C. Crilly, Esq.; Brinkley, McNerney et al.

(57) ABSTRACT

The invention is a small, portable illumination device which is used to illuminate reading material or other material. The device contains a clip which a user can employ to attach the device to a book or other reading material. The clip holds the illuminating device in place relative to the material. The device uses either battery or alternating current as power and can be switched from one to the other by insertion or removal of a male plug of a 120V AC/DC adapter into or from a jack in the device. The device can be turned on or shut off when a user switches the ON-OFF switch. In addition, there is a countdown timer which the user can set to a desired number of minutes. Once the countdown timer starts, the device will illuminate the material for the number of minutes to which the user set the countdown timer. When the countdown timer reaches zero, the device shuts off automatically. A buzzer sounds when the countdown timer reaches two minutes. There is also a display which shows the number of minutes and seconds before the countdown timer reaches zero.

34 Claims, 3 Drawing Sheets

READING LIGHT WITH SHUTOFF TIMER

BACKGROUND OF THE INVENTION

1. Field of the Invention

This invention relates generally to a device for illuminating reading material. More specifically, this invention relates to a light source which can be clipped onto a book or other reading material. The light source contains a timing device which the user may set so that the lamp which provides the light turns off after a selected number of minutes so that, if the user falls asleep without turning off the lamp or otherwise forgets to turn off the lamp, the lamp will not burn indefinitely.

2. Discussion of the Related Art

Applicant is unaware of any booklight having all the features and aspects of the present invention.

The following prior art is known to applicant:

U.S. Pat. No. 5,997,165 to Lehrer discloses a reading light source which the user wears about the head. The illumination source is in a separate unit. The light travels to a remote lamp via a fiberoptic cable. The present invention differs from the teachings of Lehrer in that, in the present invention, the light source clips to the reading material and there is no remote illumination source. Further, the present invention has a countdown timer to shut off the device, a feature which is not taught by Lehrer. Lehrer also does not teach a rotatable coupling by which the lamp can be rotated.

U.S. Pat. No. 4,283,661 to Doty discloses an ultraviolet or infrared irradiation apparatus with a detachable timing mechanism. Doty teaches the timing mechanism as a separate unit which is connected into the circuit which supplies power to the irradiation apparatus. The present invention differs from the teachings of Doty in that Doty does not disclose a lamp which can be used for reading. Doty teaches away from the present invention in that Doty warns the user about eye damage from the irradiation apparatus because the wavelengths of the radiation are harmful to the eyes. Further, Doty does not teach a device which can be clipped to a book or other reading material nor does Doty teach an integral shut-off timer. The irradiation apparatus of Doty is a large, floor-stand lamp as opposed to the small, portable light of the present invention. Doty does not teach a rotatable coupling.

U.S. Pat. No. 5,163,748 to Messinger discloses a clipboard which can be illuminated from a light source internal to the clipboard. The light source makes the clipboard itself glow. Messinger teaches that the clipboard has a clamp for holding reading materials. The clamp has a clock built into it. The present invention teaches a clip without any board. The clock in the teachings of Messinger is a time-of-day clock which performs no control function, that is, it is simply a clock attached to the clamp portion of the clipboard. This clock has no ability to shut off the light source while the present invention teaches a countdown timer which will cause extinguishment of the light source. The light source in Messinger backlights the material; the light source in the present invention lights the material from the front. If the material placed on the clipboard taught by Messinger is not completely transparent, the amount of light passing through the material is unsatisfactorily reduced. Thus, if completely opaque material is placed on the Messinger clipboard, no light will pass through the material and the material can be read only by that small percentage of the light that leaks out from around the edges of the clipboard or the material. In the present invention, the degree of transparency is irrelevant to the amount of light falling on the material. Messinger does not teach a rotatable coupling.

U.S. Pat. No. 5,469,346 to Haut et al. discloses a signaling lamp to be used by hunters and others so the users can find a hunting location in the dim or nonexistent daylight of an early morning. The hunters place the lamp at a desired hunting location the night before that morning. Haut teaches a lamp with a clock which can be set to turn on at a specified time so that the lamp need not emit signals all night long. The lamp taught by Haut has a normal flashlight capability not connected to the timer. Haut teaches a lamp with a slidable cover which, when opened, reveals the section which will emit the signals. This signal is not intended to give the level of or period of constant illumination necessary for reading a book or other material under normal circumstances. The flashing can be quite irritating to someone trying to read. Haut does not teach any clip. Haut does teach a timer that will shut off the flashing light after a period of time. Haut does not teach a rotatable coupling.

U.S. Pat. No. 5,138,538 to Sperling teaches a home-use flashlight with self-extinguishing feature to prevent draining of the battery if the flashlight is left with its on-off switch in the on position. Sperling teaches that the flashlight will shut off after a period of time which, in some embodiments, the user may select or control. The present invention contains a clip which is suitable for clipping the light to a book or other reading material. Sperling does not teach any such clip. The absence of this clip means that the teachings of Sperling require the user to use both hands if the user needs to read something, one hand for the light—which can move around relative to the material—and the other hand for holding the reading material. The present invention teaches a light temporarily fastened by its clip to the reading material. Sperling does not teach a countdown timer nor a display of the time remaining before the light will shut off. Sperling does not teach a rotatable coupling.

U.S. Pat. No. 6,249,089 B1 to Bruwer discloses a battery-saving mechanism which shuts off power to a battery-powered circuit for brief durations of time. Bruwer teaches that the mechanism may be external to a battery or may be built into the battery. Bruwer teaches a mechanism which shuts off current when voltage in a circuit drops to or below a preselected level during which shutoff period a capacitor recharges the battery. Bruwer teaches a timer that turns the circuit back on after some preselected, short, unit of time and which may give the user the illusion that a flashlight using the teachings of Bruwer is constantly lighted. Under certain circumstances, the device may have a delayed shutoff function, but Bruwer does not teach a user-controllable countdown timer with a display for delaying shutoff nor any way the user can select the period before the current is shut off. There is no user accessible control device as taught in the present invention. It would appear that the delayed shutoff function taught by Bruwer is an outgrowth of merely leaving the current on until it falls below a certain level. Thus, the time before shutoff is a function of a variety of factors—temperature, charge in the battery, etc.—all out of control of the user as opposed to the teachings of the present invention which give the user complete control over the time before shutoff. Bruwer does not teach a clip for attaching the flashlight to reading material. Bruwer does not teach a rotatable coupling.

SUMMARY OF THE INVENTION

An object of this invention is to provide a small, portable light which can be clipped onto a book or other reading material so that a user can read the material without need for illuminating an entire room or other area. A common situation involves someone reading in bed while another person nearby is asleep or trying to sleep. Confining a light source to the area of the reading material minimizes the disturbance that the light may create for other persons.

In addition, the disclosed invention is small and portable. That means that the light can also be useful in other situations. An example might be a passenger in an automobile reading a book or a map or instructions when it is dark outside. It is well-known that drivers may find it difficult to see the roadway when there is a significant source of light from within the automobile. The passenger using the disclosed invention helps the driver avoid having problems of visibility. The disclosed invention is superior to maplights often installed in automobiles in that it can be used by any person in the automobile, including back seat passengers, and armed in such a way that the amount of light perceived by the driver can be minimized.

In a further situation, the disclosed invention might be used where the user has no other light source available, such as when camping in the woods.

Previous solutions to the above problems exist. A common solution to the reading in bed problem is a small, high intensity lamp usually powered by an alternating current source. Such lamps lack portability and must rest on a table or nightstand or other surface. The disclosed invention has a clip which allows the user to clip the lamp to the reading material. This has the further advantage of keeping the light steady relative to the reading material no matter how much the user moves around in the bed or elsewhere. If the user happens to be walking, the light source remains on the reading material without any further intervention of the user.

The clip has the additional advantage of freeing the user's hands for holding the reading material or for anything else the user wishes to do, such as adjust the volume on a radio or TV.

The disclosed invention has a further advantage in that it can be set to automatically shut itself off after a pre-selected number of minutes. It is common that persons reading in bed fall asleep before turning off the light. In such case, the light continues to burn until it is shut off or, in the case of battery-powered lights, the batteries run down.

Another advantage of the disclosed invention is that it is small so that it can be carried in a pocket, backpack, or purse, kept in a drawer or glove compartment, or left on a table without taking up much room. This small size has the further advantage of keeping the weight down so the disclosed invention does not increase the weight of the reading material to any significant degree.

It should be noted that the term "lamp" has two primary meanings herein. In reference only to the teachings of Doty, the term refers to an entire illumination apparatus. These apparati are often referred to as sunlamps and are not designed to provide visible illumination.

In contradistinction to its use in the teachings of Doty and in all other contexts herein, the term "lamp" is used as it is used by persons of ordinary skill in the electrical arts, namely, as roughly synonymous with what is vernacularly called a "light bulb". A lamp, then, is something which emits visible light i.e. light which illuminates a surface to assist a viewer to see the surface when a sufficient current is applied thereto. A lamp is a component of an illumination device and not the illumination device itself.

The term "light" refers to illumination or light energy and not to any part of the disclosed device. Light is the product of an illumination device.

DETAILED DESCRIPTION OF THE PREFERRED EMBODIMENTS

Figure 1:
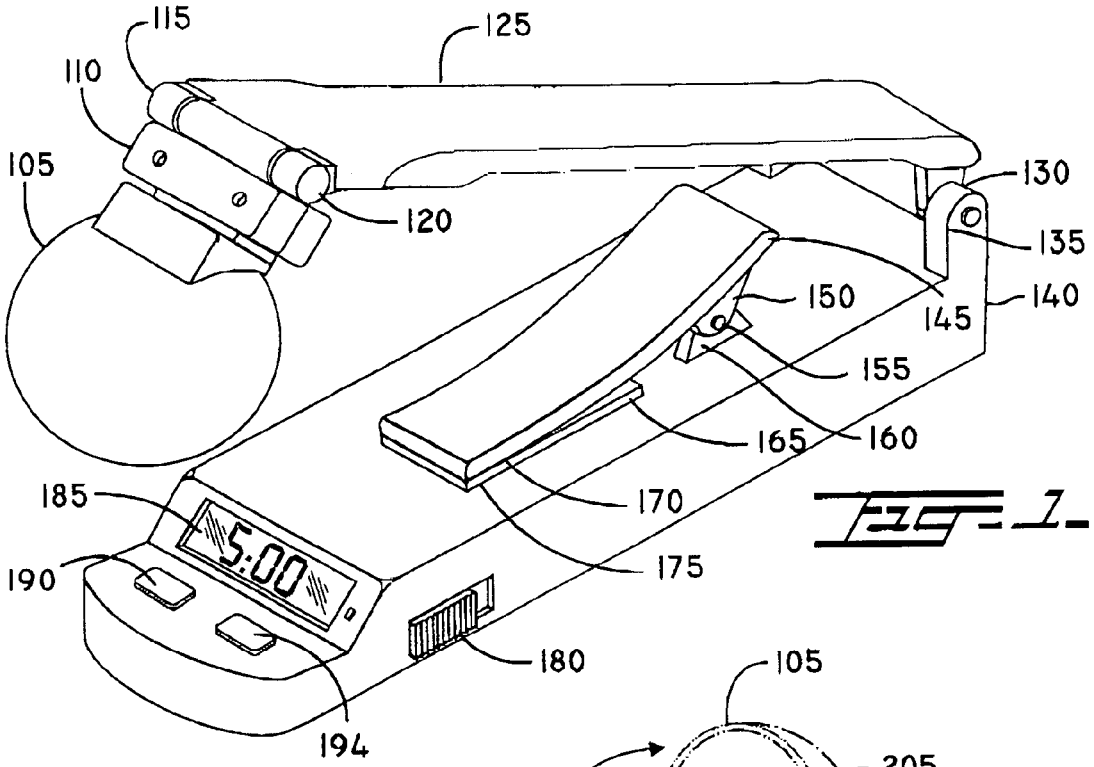
FIG. 1 is a perspective-view of the disclosed invention from above the front, right comer.

As a result of the large number of children in America whose educational careers are imperiled because they do not read well enough to ensure understanding and meet the demands of a competitive economy. The U.S. Department of Education and the U.S. Dept of Health and Human Services asked the National Academy of Sciences to establish a committee to examine and provide advice and guidance for parents and educators on the prevention of reading difficulties in young children. In 1998 the committee published a highly regarded and lengthy report named "Preventing Reading Difficulties in Young Children" It is due to several of the committee's recommendations that this concept was invented, namely:

Throughout the early grades, time, materials and resources should be provided with 2 goals: (a) to support Daily Independent Reading of texts selected to be of particular interest for the individual student and (b) to support daily assisted or supported reading and rereading of texts that are slightly more difficult.

Throughout the early grades, schools should promote independent reading outside school by such means as Daily at-home reading assignments and expectations, summer reading lists and encouraging parent involvement.

This report has resulted in many school districts nationwide requiring parents to sign off on daily timed reading and homework assignment logs. Students are required to read for a period of 30 minutes per day in addition to other homework. It is the timer function and the portability of the product that allows parents and kids to monitor their required sessions in an area of their choice.

This invention addresses needs particularly in the following areas:

Preschool Children (Early Readers). The recommendation suggests that parents from a very early age should read to their child. The idea of the portable booklight allows the parent to take the child into a "quiet place" for their reading session (also recommended by many reading specialists). The light itself also gives interest to the child as it is a fun object. The timer function allows the parent to read for the designated minutes. Note that it is the tranquil setting of a parent with a child that encourages the independent reading.

Children (K–12 grade). As noted above school districts and principals require children to read a minimum of 30 minutes per day. This has culminated in parents actually having to sign daily reading logs, verifying that their child has read for that time allotment. Again the timer function allows the child to go into a place, set the time and read the set number of minutes, without having to bother their parents for time updates or refer to a clock. Note the portability also allows kids to read in daily routine places such as sports fields, restaurants, park benches or in a tent, a dark corner of their room.

Continuing Education Timed Assignments. At high school and college, students increasingly are faced with timed assignment work (math, sciences, English etc), either as classwork, homework or tests or for test preparation. The timer function will facilitate all of these events.

All persons can find ready use for this invention while traveling on trains and buses and in cars.

According to one embodiment of the present invention, there is provided a booklight with integral shutoff timer and display. The device consists of three main parts —a base, an arm, and a lamp and cover. The lamp cover is rotatably connected to the arm which, in turn, is rotatably connected to the base. The lamp cover contains an electrical socket into which a replaceable lamp is inserted. Because such lamps do burn out, the user has access to the lamp for removal and replacement. In the preferred embodiment this lamp is a 4.8 v, 0.3 amp lamp.

The lamp cover is roughly a half hemisphere although in other embodiments other shapes may be employed. The lamp cover may rotate 360 degrees by a rotatable coupling about a line from the rear of the socket with the axis of rotation being roughly the longitudinal axis of the socket. The lamp cover serves to reflect light from its interior surface, and may or may not be covered with a reflective material. The lamp cover directs the light where the user wants the light to be and prevents the light from bothering others or even the user. In addition, because lamps can become very hot when they are in operation, the lamp cover serves to protect the user or others from coming into contact with the lamp.

In another embodiment, the lamp cover 105 has a transparent shield 207 attached, for example, with screws and spanning the dividing plane of the hemisphere or other shape. The shield serves both to further protect the user from contact with the lamp 205 and to protect the lamp from contact with objects or the user. Further, this shield serves to keep children from touching or removing the lamp. In some embodiments, the lamp could be of a type that must not be touched directly by a human or otherwise contact oil from human skin or elsewhere. It is well-known by those of ordinary skill in the art that any oil on the surface of many types of lamps, in particular halogen lamps, drastically reduces the useful life of that lamp.

The lamp cover, the lamp, the optional shield, the socket, and whatever parts are necessary to connect these parts together form a lamp cover assembly.

The lamp cover assembly is connected to the arm by a first hinge mechanism. This first hinge permits the dome lamp cover assembly to travel through a range of angles so the user may determine the most desirable angle for gaining the greatest benefit from the device. In one embodiment, the axis of rotation of this first hinge lies normal to the arm and parallel to the base. The arm is formed from one or more simple struts which may be hollow. In the embodiment in which the arm is hollow, electrical wiring may run through the hollow arm from the lamp socket to the base. In the preferred embodiment, there is one strut but multiple strut embodiments can be devised.

The lamp cover may be connected to the arm in such a way as to rotate about a multiple of axis and hence, has multiple degrees of freedom.

At the end of the arm opposite the first hinge connecting the arm to the dome lamp cover assembly is a second hinge. This second hinge connects the arm to the base. The axis of rotation of this second hinge is parallel to the axis of rotation of the first hinge. This second hinge provides the user with additional range for adjusting the position of the lamp cover assembly to give the user light where the user wants the light to be.

In the embodiment shown, the base has the general shape of a rectangle with parallel sides and one dimension two or more times greater than the other dimensions. In one embodiment, the base is 1¾" wide, 1¾" high, and 6¼" long although other embodiments may have other dimensions.

At the back end of the top side of the base in one embodiment, one or more pedestals form the base portion of the second hinge. Further forward on the top side of the base lie one or more other pedestals. These pedestals serve as points of attachment for the fulcrum of a clip to be described below. Further forward of the fulcrum is a small rubber pad which assists in the function of the clip. In the preferred embodiment, there are two pedestals at the rear and two further forward.

At the front end of the base is a display. This display may be on the top of the base, on the front end of the base, or, in yet another embodiment, may lie at an angle from the top to the front, giving the front of the base a bevel. Adjacent to the display are, in one embodiment, two buttons. These buttons may be covered with rubber boots just large enough to cover the buttons.

On one side of the base lies an ON-OFF switch. In the preferred embodiment, this switch is a slide switch and is located on the right side of the base. However, those of ordinary skill in the art will know that there is a wide range of other switches which will work. This switch, as its name implies, functions to turn the current in the circuits on or off depending on the position of the ON-OFF switch.

The underside of the base defines an access opening covered by an access panel. In one embodiment, this access panel is attached to the base with one or more screws. The screws serve both to hold the access panel in place and to prevent children from easily removing the panel, which, if not present, could present the danger that a child could be inquired by swallowing a battery. Removal of the panel provides access to a battery compartment. It is common for children and even adults to remove batteries from devices. Further, if the disclosed invention is dropped or struck, the screw serves to hold the access panel in place. Without this screw, it is possible for the shock of a blow to cause the access panel to become separated from the device and for the batteries to spill out. With the panel held in place by one or more screws, this is far less likely to happen.

Within the compartment covered by the access panel lies a battery holding area and its attendant circuitry. Such battery holding areas and attendant circuitry are well-known to those of ordinary skill in the art. In one embodiment, the battery holding area holds four type AA dry-cell batteries although other embodiments are possible.

In addition to the access panel on the underside of the base, there is provision for access to the internals of the base portion of the present invention. This area is not intended for access by the user. However, access for skilled technicians is provided. The various methods of giving access to skilled technicians and not ordinary users include a need for special tools and other means well-known to those of ordinary skill in the art.

In one embodiment, there is a female jack fitting for accepting a 120V AC/DC adapter of 120V input with an output of 6V, 0.3A 2.5 mm male plug. When the male plug of this adapter is inserted into the female jack and the other end of the adapter is inserted into a 120V power source, the disclosed invention operates using power from the adapter as the power source. When the power source is not via this jack, the disclosed invention operates using battery power supplied by the batteries in the battery storage compartment.

In another embodiment, the device can be constructed to have full time 120V current as its power source, and can employ a battery charger which will cause the batteries to be charged when external power is supplied to the device.

In the interior of the base is a printed circuit board or PC. This PC, in a preferred embodiment, contains a microprocessor chip, preferably a type DM039 chip. This PC is electrically connected to all the other circuits in the present invention. One of the circuits runs from the PC to the electrical wiring that powers the lamp. This wiring, as already specified in part, runs from the PC through the base, across the second hinge, through the arm, across the first hinge, through the rotatable coupling, and connects to the lamp socket. In one embodiment, multiple rotations of the lamp cover assembly in one direction can place significant stress on the electrical wiring. In another embodiment, the electrical connection through the coupling can be made by plates in constant contact or by other means well-known to those of ordinary skill in the art. In another embodiment, stops can be installed which prevent the lamp assembly from being rotated more than 360 degrees. The details of these stops and other means for limiting rotation to 360 degrees are also well-known to those of ordinary skill in the art.

The PC is connected to the display. The display is, in a preferred embodiment, a four-digit liquid crystal display, LCD, with a colon between the second and third digits. Other embodiments, such as light emitting diodes, ("LEDs"), may be used if appropriate design changes, well-known to those of ordinary skill in the art, are included. This display shows the number of minutes and seconds remaining before a countdown timer circuit counts down to zero with the minutes shown in the leftmost two digits and the seconds in the rightmost two digits.

In the preferred embodiment, there are two buttons or keys. One of these buttons is labeled SET on the base. When the ON-OFF switch is in the off position, the user presses SET. This turns on the LCD which contains its own internal illumination lamp, a common 3 mm lamp. The initial value of the display may be set to five minutes or any other time. The minute portion of the LCD will flash. Each time the user presses the SET button, the minute portion will increase in five-minute increments (or any other desired increment) up to a maximum of ninety minutes (or any other amount of time). If the display reads ninety minutes and the user again presses the SET button, the display will cycle back to five minutes. If, after pressing the SET button, the user does not press any button for ten (10) seconds, the display will return to state it was in before the SET button was depressed (i.e. the timer will continue down or go back to zero).

If the user holds down the SET button, the minute display will increase continuously in five-minute increments.

After setting the timer, the user presses the button labeled START on the base to activate the countdown timer. The countdown timer begins to countdown to zero in one-second increments. When the countdown timer reaches two minutes, a buzzer may optionally be employed to sound as a warning. The lamp and countdown timer will be automatically shut off when the countdown timer reaches zero, that is, the display reads 00:00.

When the countdown timer is active, the user may reset the timer, that is, change the number of minutes before zero, by pressing the SET button. At this moment, the countdown timer will stop and the minute field will hold at the minute value. The seconds field will clear to zero, that is, :00. When the user again presses the SET button, the minute value will increase to the next higher five-minute value. The user may then set the timer as before, up to a maximum of 90 minutes.

After setting the new value in the countdown timer, the user again presses START to re-activate the countdown timer at its new value. If the START key is not pressed within ten seconds, the display and countdown timer will return to the value in the countdown timer from before the SET button was pressed. This prevents accidental touching of the SET button from clearing the countdown timer.

If the user wishes to stop the countdown timer when it is in countdown mode, the ON-OFF switch may be turned to the ON position. This clears the display and countdown timer. The light will then remain on until the ON-OFF switch is switched to the OFF position.

In an alternative embodiment, a third button is labeled RESET (not shown) on the base. The RESET button, when pressed, clears the countdown timer to zero or 00:00. This shuts off the lamp until the ON-OFF switch is set ON or until the user enters a time in the countdown timer. The RESET button can be used if the user has the disclosed invention in countdown mode and wishes to avoid the sounding of the buzzer or wishes to shut off the lamp without waiting for the countdown timer to count down to zero. Using the RESET button provides an alternate method to setting the ON-OFF switch to ON and clearing the countdown timer then setting the ON-OFF switch to OFF. RESET can also be used if the user has inadvertently incremented the countdown timer to a value higher than that which the user wishes. The user can simply reset the countdown timer to five minutes and begin incrementing again. This is an alternate method to going all the way through the range of minutes past ninety and working back up to the desired time value.

The display, the buttons, and components of the PC form a control device which controls the functions of the disclosed invention.

In the preferred embodiment, the present invention contains a clip. This clip, as noted above, consists of two parts connected at a fulcrum—an upper portion and one or more pedestals on the top side of the base. These pedestals can be separate parts which are attached to the base by methods well-known by those of ordinary skill in the art or can be formed by a molding or machining or other process to be a part of the top of the base. In some designs, just one pedestal may act as the fulcrum.

The upper portion of the clip—the jaw—is a separate piece which is formed to have one or more pedestals underneath it. This pedestal fits around or between the pedestals on the top of the base. A pin or other means well-known to those of ordinary skill in the art connects the clip to the top portion of the base. This pin is, in the preferred embodiment, roughly parallel to the axes of rotation of the first and second hinges but may be arranged in almost any plane so long as the function of the clip is achieved.

A spring supplies force to the rear part of the jaw. In one embodiment, the spring is a spring wound around the pin with the standing part pressing against the rear of the underside of the jaw and the bitter end pressing against the top of the base to the rear of the fulcrum pedestal. Other types of springs exist in other embodiments. A coil spring set between the rear of the underside of the jaw and the top of the base behind the pedestal is another embodiment. Whatever spring is used acts like a lever with the force applied against the rear of the underside of the and the pedestal fulcrum acting as the fulcrum. This lever force acts to press the front of the underside of the—the pincer—tightly against the top of the base.

The clip serves to hold the reading material or other illuminated object in place. One can also conceive of the clip holding the light in place relative to the illuminated object. The two notions are the same.

In a preferred embodiment, the top of the base and the underside of the jaw have serrations formed between the fulcrum and the front of the jaw. In addition, a rubber pad is affixed to the top of the base where the jaw touches the top of the base. The serrations and rubber pad assist the lever force in keeping the present invention and the illuminated material in place relative to one another. In another embodiment, a rubber pad is affixed to the pincer instead of to the top of the base. In yet another embodiment, rubber pads are affixed to both the jaw and to the top of the base where the jaw contacts the top of the base.

To use the clip, the user presses against the rearmost part of the jaw in the direction of the top of the base. This exerts a force sufficient to overcome the spring force. This force opens the clip. The user can then insert the material to be illuminated. The user then relaxes the force on the rearmost portion of the clip. This permits the spring to exert a lever force on the jaw and close the clip.

While this specification concludes with claims defining the features on the invention that are regarded as novel, it is believed that the invention will be better understood from a consideration of the following description in conjunction with the drawing figures.

FIG. 1 is a perspective view of a preferred embodiment of the disclosed invention from above the right, front corner. At 105 is the back or top of the lamp cover. This connects with a rotatable coupling 110 to the first hinge assembly 115. The rotatable coupling rotates through a full 360 degree range. At 120 is the axis of the first hinge assembly 115. This hinge assembly permits the lamp cover assembly, formed of 105 and 110, to swing through an arc around the axis 120. An arm 125 contains one end of the first hinge 15. At the other end of the arm 125 is the second hinge 130 with its axis of rotation at 135. This second hinge 130 permits the arm 125 to swing about the axis of rotation 135.

The base of the disclosed invention is at 140. On top of the base is the clip formed of an upper portion 145 and one or more pedestals 150 which connect through a pin 155 to one or more pedestals 160 on the base 140. On the top side of the base 140 and under the 145 are serrations 165 which assist in holding the illuminated material in place. A jaw 145 is at 170. Under 170 is a rubber pad 175 which may be attached to either the 145 or to the base 140 or both. The ON-OFF switch is at 180 and shown on the right side of the base 140. At 185 is the display which displays the number of minutes and seconds remaining before the countdown timer counts down to zero and shuts off the lamp when the disclosed invention is in countdown mode.

At 190 and 194 are two buttons for controlling the countdown timer. The SET button is at 190 the START button is at 194.

Figure 2:
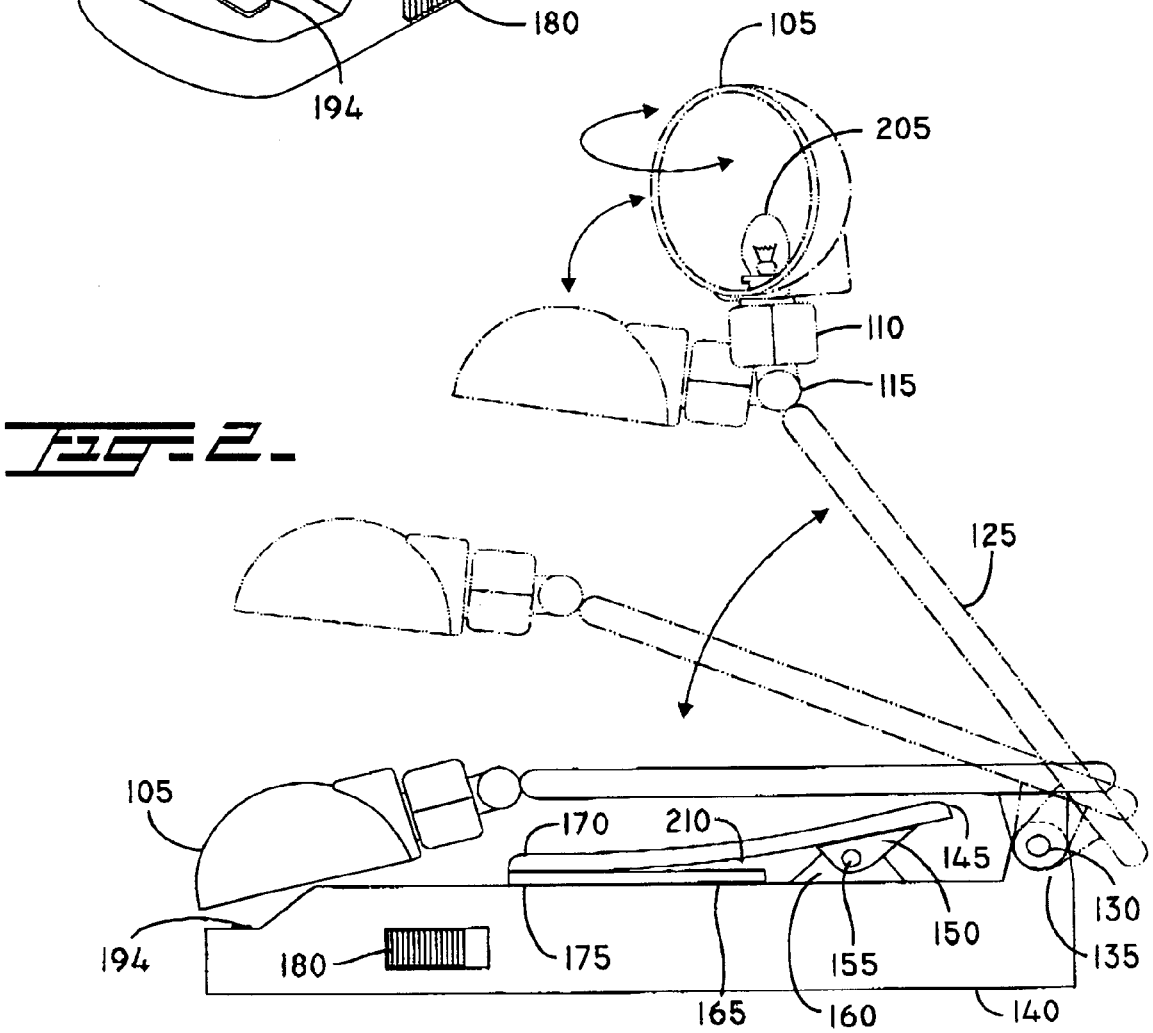
FIG. 2 is a view of the right side of the disclosed invention.

FIG. 2 shows a right side view of the disclosed invention. At 205 is the lamp which provides the illumination. At 210 are serrations on the underside of the 145.

FIG. 2 shows the arm 125 in both a raised and collapsed position. The light cover 105 in the part of FIG. 2 in which the arm 125 is raised shows the light cover 105 rotated about the rotatable coupling 110 and about the first hinge 115.

Figure 4:
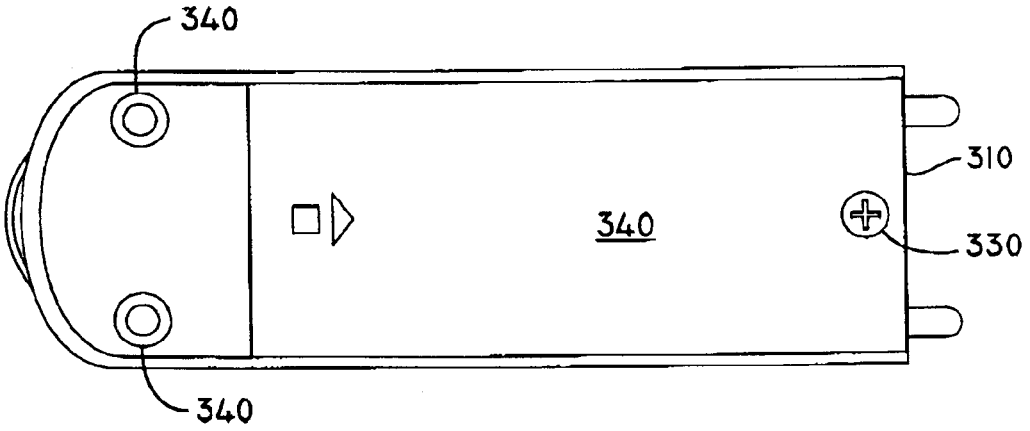
FIG. 4 is a view of the bottom of the disclosed invention.

FIG. 4 shows a view of the bottom 310 of the base 140 of the disclosed invention. The bottom 310 contains a removable access cover 340 giving the user access to the battery storage compartment within the base 140. In one embodiment, the removable access cover 340 is held in place by at least one fastener such as screw 330. Access to the internals of the base 140 is obtained, in part, by removal of fasteners 340.

Figure 3:
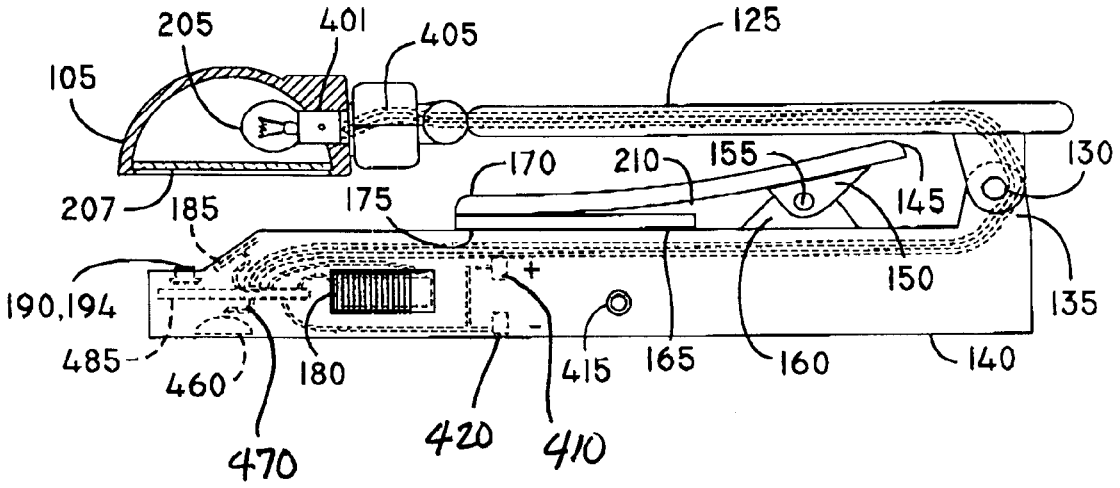
FIG. 3 is a cutaway view of the right side of the disclosed invention with internal components shown schematically.

FIG. 3 shows a cutaway view of the right side of the disclosed invention. At 205 the lamp is shown inserted into socket 401 and connected by wires 405 which run along or through arm 125 into base 140 terminating at the control device controlled by the printed circuit board (PC) 485. PC 485 controls the display 185, the lamp 205, and the buzzer 460. The user presses one or more buttons 190 and 194 to control the countdown timer. These buttons may have rubber boots around them. The buzzer is connected to the PC by a buzzer wire 470.

On the right side of the base 140 is the ON-OFF switch 180 which has a positive side 410 and a negative side 420. In the positive mode, the lamp is on. In the negative mode, the control device will turn on the lamp if the countdown timer contains a value greater than zero.

Wires connect the control device to the buttons 190 and 194 and the display 185.

Lamp 450 illuminates display 185 under control of the control device.

Figure 5:
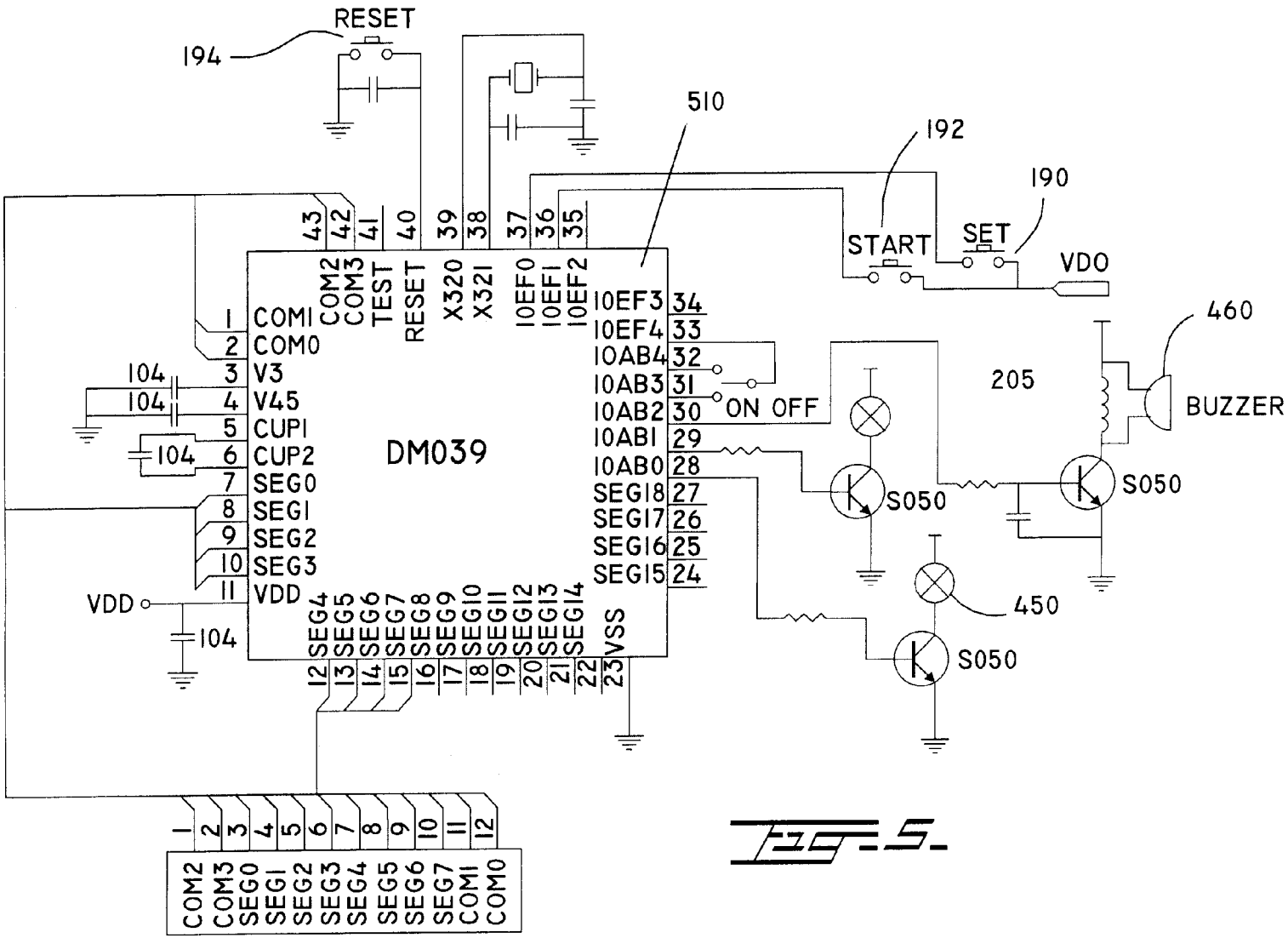
FIG. 5 is a schematic diagram of the printed circuit board.

FIG. 5 is a schematic representation of a control system for use with thee invention including the PC board 485. Identified are the controls for the lamp 205, the output to the display illuminating lamp 450, the buzzer 460, the SET button 190, and the START button 194. On the PC board 485 is a microprocessor chip 510 identified as a type DM039.

Various modifications and alterations of this inventions will become apparent to those skilled in the art without departing from the scope and spirit of this invention, and it is understood that this invention is not limited to the illustrative embodiments set forth hereinbefore.

I claim as follows:

1. An illumination device comprising the following:

a lamp;

a lamp cover assembly comprising a lamp cover, a socket into which said lamp is inserted, and a rotatable coupling;

an arm rotatably connected to said lamp cover assembly by a first hinge located at one end of said arm;

a base rotatably connected to said arm by a second hinge located at an end of said arm most remote from the end to which said first hinge is connected;

a power source;

electrical circuitry sufficient to send power from the power source to the lamp, such that the lamp illuminates with a predetermined intensity;

a countdown timer, coupled to the electrical circuitry, that maintains the flow of power to the lamp via the electrical circuitry to permit the lamp to maintain illumination at the predetermined intensity until expiration of a user-defined time period and then automatically disconnects the flow of power to the lamp upon expiration of the user-defined time period;

a control device providing a user with the capability of setting the user-defined time period; and a clip rotatably connected to said base and operable to attach the base to an object of illumination.

2. The illumination device of claim 1, wherein the lamp comprises a 4.8 v, 0.3 amp lamp.

3. The illumination device of claim 1, wherein said lamp cover is rotatably coupled such that said lamp cover rotates through 360 degrees about an axis collinear with a long axis of the arm.

4. The illumination device of claim 1, wherein the lamp cover assembly further comprises a clear shield attached to the lamp cover, such that the lamp cover assembly completely encloses the lamp.

5. The illumination device of claim 4, wherein said clear shield is attached to the lamp cover with at least one screw.

6. The illumination device of claim 1, wherein the electrical circuitry further comprises wiring connecting the base to the lamp.

7. The illumination device of claim 1, wherein the power source resides within said base and wherein an underside of said base includes a removable panel providing the user the capability of gaining access to and replacing the power source.

8. The illumination device of claim 7 further comprising at least one screw fastening said panel to said base.

9. The illumination device of claim 1 wherein said power source is at least one dry-cell battery.

10. The illumination device of claim 9, wherein the at least one dry cell battery comprises four type AA dry-cell batteries.

11. The illumination device of claim 1 wherein said power source is an alternating current power source.

12. The illumination device of claim 11, further comprising an AC/DC adapter 120V input with output of 6V, 0.3A, 2.5 mm male plug, insertion of said adapter into a connection port in the base, wherein the power source further comprises a battery power source and wherein the electrical circuitry includes capability of overriding the battery power source.

13. The illumination device of claim 12, wherein removal of said adapter from said connection port returns the power source to the battery power source.

14. The illumination device of claim 1 further comprising at least one printed circuit board.

15. The illumination device of claim 14 further comprising at least one microprocessor chip.

16. The illumination device of claim 15 further comprising a type DM039 microprocessor chip.

17. The illumination device of claim 1, further comprising an ON-OFF switch that is accessible by the user and has the capability of completing or disconnecting the flow of power to the lamp.

18. The illumination device of claim 17, wherein placing the ON-OFF switch in the ON position turns on the lamp and placing the ON-OFF switch in the OFF position turns off the lamp, unless the countdown timer is activated, in which case, the lamp is turned on.

19. The illumination device of claim 1, wherein the control device comprises a set button for setting the user-defined time period into the countdown timer.

20. The illumination device of claim 19, wherein the user-defined time period is set to five minutes for each press of the set button.

21. The illumination device of claim 20, wherein the user-defined time period will reset to five minutes if the set button is pressed when the user-defined time period is set to ninety minutes.

22. The illumination device of claim 1, wherein the control device comprises a set button for setting the user-defined time period, and wherein the countdown timer automatically turns off if the set button is not repressed within two minutes of the time that the set button was previously pressed.

23. The illumination device of claim 19, wherein the maximum number of minutes to which the user-defined time period can be set is ninety minutes.

24. The illumination device of claim 19 wherein the countdown timer enters a standby mode if the set button is not pressed again within five seconds after the set button is pressed.

25. The illumination device of claim 1, further comprising an alerting mechanism that alerts the user at a predetermined time prior to the countdown timer disconnecting the flow of power to the lamp.

26. The illumination device of claim 25, wherein the alerting mechanism emits a sound as a warning two minutes prior to the countdown timer disconnecting the flow of power to the lamp.

27. The illumination device of claim 26, wherein the alerting mechanism emits a sound four times as a warning.

28. The illumination device of claim 1, further comprising a display that provides the user with a visual representation of the time remaining in the user-defined time period and at least one button electrically connected to the control device for providing the user the capability of causing preselected functions to be performed by the control device, wherein said display comprises a display illumination source which illuminates the display whenever the at least one button is pressed.

29. The illumination device of claim 28, wherein the display includes a 3 mm lamp.

30. The illumination device of claim 28, wherein said display is a liquid-crystal display.

31. The illumination device of claim 1, further comprising a start button for starting the countdown timer.

32. The illumination device of claim 1, further comprising a reset button for resetting the countdown timer.

33. The illumination device of claim 1, wherein the clip comprises:

an upper section having a plurality of serrations on an underside thereof and further having a hinge end and a pincer end remote from the hinge end;

a pedestal attached to said base, wherein said upper section is rotatably connected to said base through said pedestal at the hinge end of said upper section; and a rubber pad attached to the base at the point at which the pincer end contacts the base, said rubber pad preventing the object of illumination from slipping out from under the serrations of the upper section.

34. The illumination device of claim 1, wherein no dimension of the illumination device is greater than approximately six and one-quarter inches.

* * * * *